United States Patent [19]

Feliks et al.

[11] Patent Number: 4,674,935

[45] Date of Patent: Jun. 23, 1987

[54] FEEDER MECHANISM

[75] Inventors: James J. Feliks, Doraville; Will L. Culpepper, Covington, both of Ga.

[73] Assignee: The Mead Corporation, Dayton, Ohio

[21] Appl. No.: 869,375

[22] Filed: Jun. 2, 1986

[51] Int. Cl.[4] ..... B65G 59/06

[52] U.S. Cl. ..... 414/128; 53/307; 198/468.4; 198/470.1; 221/40; 221/211; 271/12

[58] Field of Search ..... 414/128; 53/307; 198/468.4, 470.1, 803.7; 271/12; 493/317; 221/36, 40, 211

[56] References Cited

U.S. PATENT DOCUMENTS

| | | | |
|---|---|---|---|
| 2,227,370 | 12/1940 | Seybold | 271/12 |
| 3,100,583 | 8/1963 | Erickson | 221/36 |
| 3,411,640 | 11/1968 | Wallis | 271/12 |
| 3,429,570 | 2/1969 | Scully | 271/12 |
| 3,477,199 | 11/1969 | Keas | 53/307 X |
| 3,713,648 | 1/1973 | Spika | 198/807.7 X |
| 3,908,340 | 9/1975 | Erhardt | 53/307 |
| 4,061,081 | 12/1977 | Pinto et al. | 493/317 |

FOREIGN PATENT DOCUMENTS

| | | | |
|---|---|---|---|
| 53-98687 | 8/1978 | Japan | 198/803.7 |

*Primary Examiner*—Leslie J. Paperner
*Attorney, Agent, or Firm*—Rodgers & Rodgers

[57] ABSTRACT

Mechanism for feeding a container cover out of a hopper and on to a conveyor for subsequent application to a filled container includes a pivotally mounted oscillatable support arranged to move toward and away from the hopper, suction means rotatably mounted on the oscillatable support and engageable with a container cover for withdrawing the cover from the hopper together with control means interconnected with the suction means for imparting rotation to the suction means relative to the oscillatable support so as to position the suction means adjacent the conveyor for convenient deposit of the conveyor lid on to the conveyor.

9 Claims, 16 Drawing Figures

FEEDER MECHANISM

TECHNICAL FIELD

This invention relates to packaging machines and concerns a mechanism for feeding a container cover out of a hopper and on to a conveyor for subsequent application to a filled container. The invention is particularly applicable to aseptic packaging of consumer items.

BACKGROUND ART

U.S. Pat. No. 4,152,464 issued May 1, 1979 and U.S. Pat. No. 4,409,775 issued Oct. 18, 1983 both of which are assigned to the assignee of this invention concern aseptic packaging machines and methods in which container covers are fed in an appropriate manner to positions of contact with filled containers and U.S. Pat. No. 3,908,340 issued Sept. 30, 1975 also relates to feeding lids of containers.

DISCLOSURE OF THE INVENTION

According to this invention in one form, a container cover is fed out of a hopper and deposited on to a conveyor for subsequent application to a filled container by a mechanism including a pivotally mounted oscillatable support arranged to move toward and away from the hopper, suction means movably mounted on the oscillatable support and engageable with a container cover for withdrawing the cover from the hopper together with control means interconnected with the suction means for imparting movement to the suction means relative to the oscillatable support thereby to position the suction means for convenient deposit of the container lid on to the conveyor.

BEST MODE OF CARRYING OUT THE INVENTION

Figure 1:
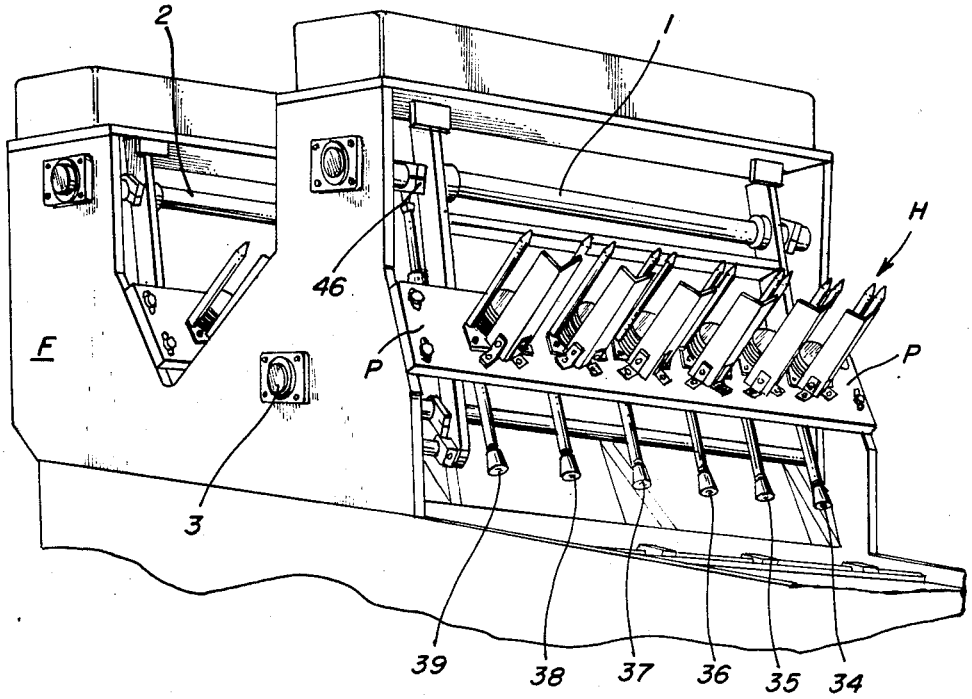
FIG. 1 is a perspective view of a portion of an aseptic packaging machine which embodies this invention.
Figure 2:
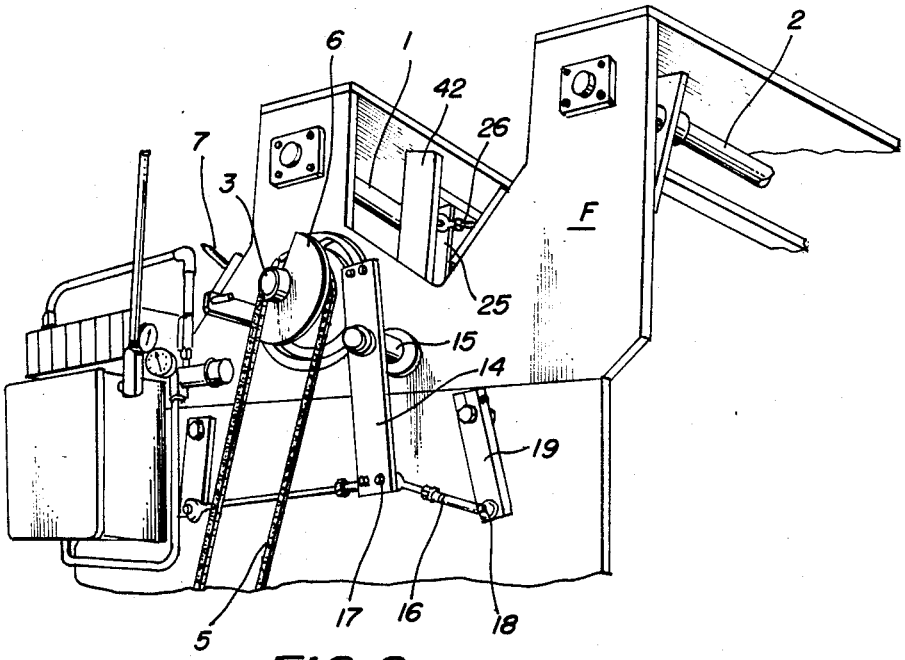
FIG. 2 is a view similar to FIG. 1 but which is taken from the opposite side of the machine from that shown in FIG. 1.
Figure 3:
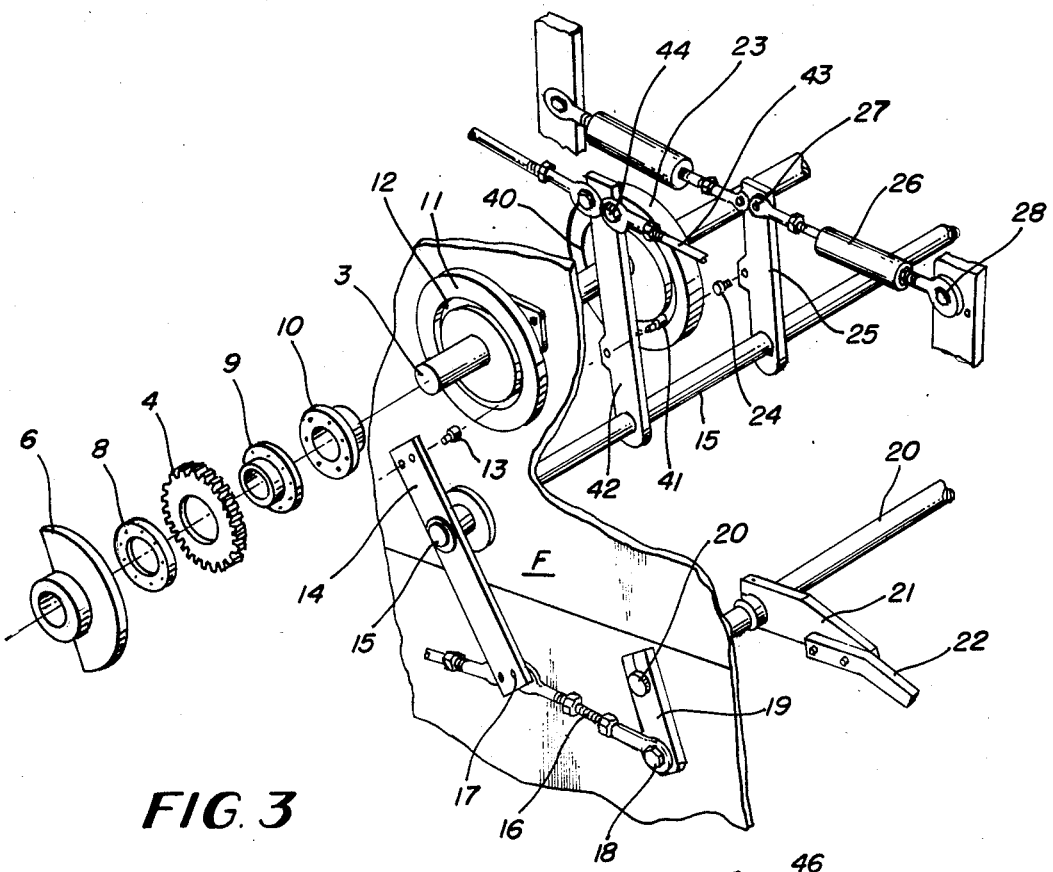
FIG. 3 is an exploded view of parts of the driving and control mechanism formed according to this invention.

With reference particularly to FIGS. 1 and 2 the frame structure of the machine is designated generally at F. Horizontal shafts 1 and 2 are journally mounted at their ends in frame F. The shafts 1 and 2 are associated with two separate and substantially identical container lid feeding mechanisms. The description and drawings are primarily concerned with but a single container cap feeding mechanism such as that which includes the shaft designated by the numeral 1. The shaft 3 as best shown in FIGS. 2 and 3 is journally mounted in frame F. A driving gear 4 is fixedly secured to shaft 3 and cooperates with a chain drive 5 driven by suitable known mechanism not shown in the drawings. Electromagnetically operable semicircular element 6 is rigidly secured to the outer end of shaft 3 and cooperates with a sensor mechanism 7 supported by the frame F and arranged to control the suction pressure within suction devices utilized to engage and withdraw container covers from a hopper. Elements 6 and 7 are of conventional construction. Spacer 8 separates gear 4 and device 6 while bearings 9 and 10 are interposed between gear 4 and cam 11 which is securely affixed to shaft 3 and includes a cam groove 12 formed on the outer surface of cam 11.

Figure 5:
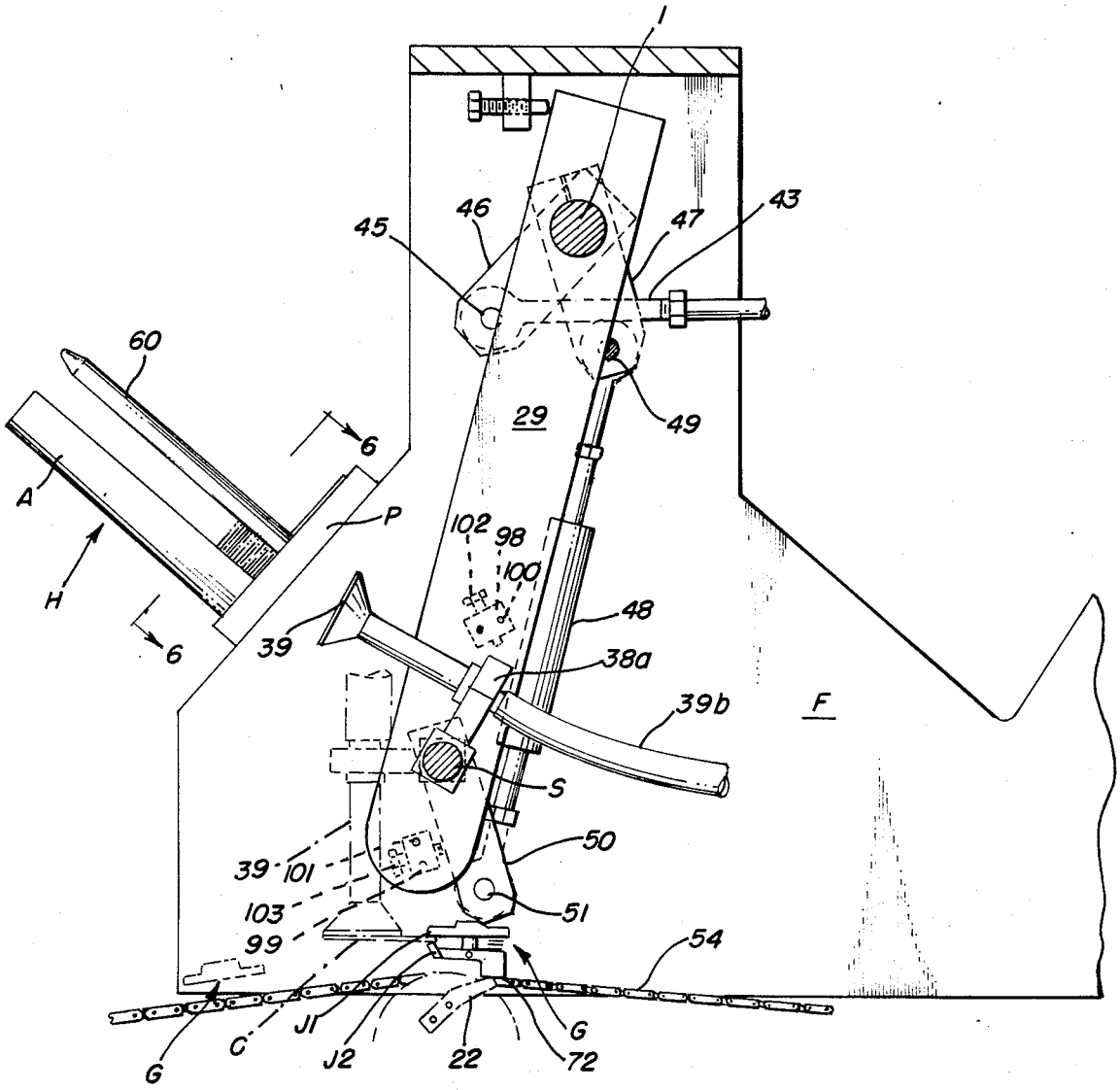
FIG. 5 is an enlarged cross sectional view of the mechanism shown in FIG. 4 and includes the hopper from which container covers are fed.

For operating the gripper jaws J1 and J2 to receive and grip a cover C as best shown in FIG. 5, cam follower 13 is mounted on oscillatable arm 14 which oscillates about fixed shaft 15 supported by frame F. To and fro motion of arm 14 imparts reciprocatory motion to turn buckle 16 which is pivoted at 17 to arm 14 and which is also pivoted at 18 to crank 19 which in turn is secured to shaft 20 in rigid fashion so as to impart oscillatory movement to crank 20 so as to impart to and fro movement to gripper operating arms 21 and 22. Gripper operating arm 22 is shown in FIG. 5 in the process of engaging jaw J2 in order to open jaws J1 and J2.

Figure 4:
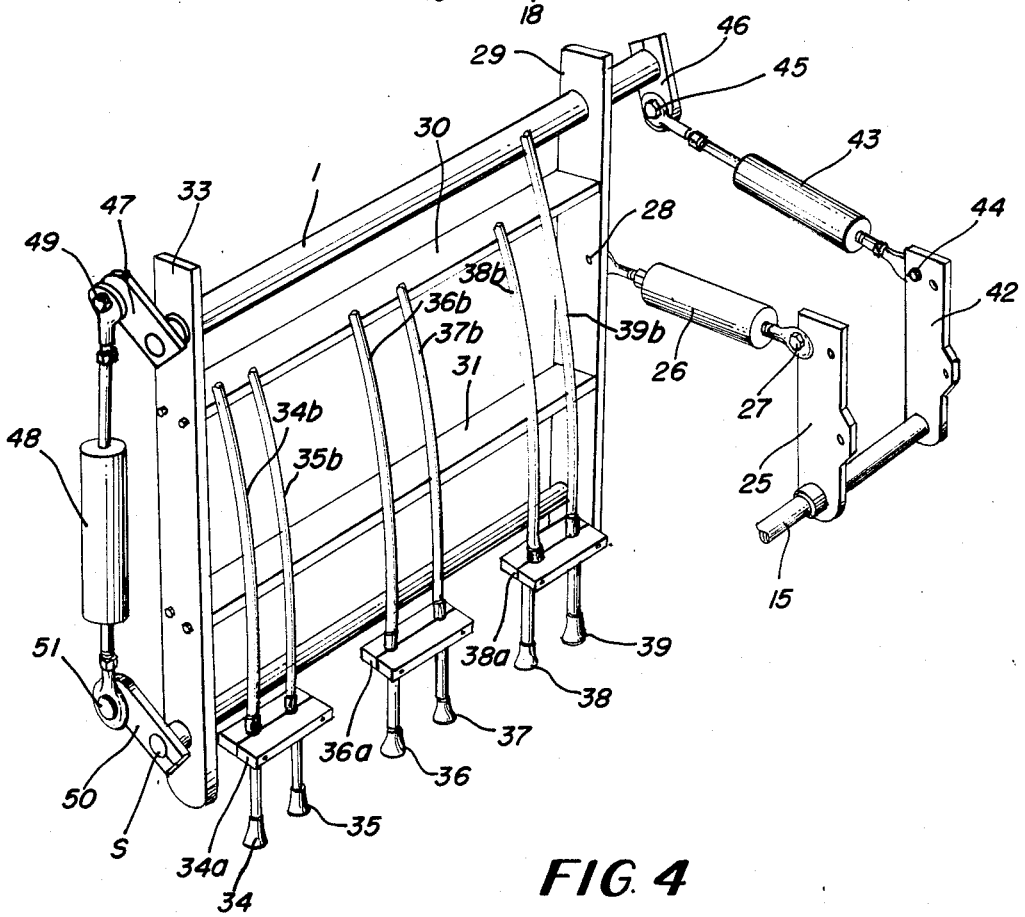
FIG. 4 is an enlarged perspective view of the oscillatable support formed according to this invention on which suction means is rotatably mounted.

For imparting oscillating movement through an angle in the range between 8 and 20 degrees, the structure inside frame F and shown generally in FIG. 4 is oscillated by cam 23 having a groove formed in its far side as viewed in FIG. 3 which groove receives cam follower 24 so that rotation of shaft 3 imparts oscillatory movement to arm 25 about shaft 15 as a pivot and in turn imparts reciprocatory movement to connector 26 which is connected at one end by a pin 27 to the rockable arm 25 and at the other end is connected by a pin 28 to an oscillatable support arm 29 which is arranged to oscillate through an angle between 8 and 20 degrees about the shaft 1 as a center. Oscillatable support arm 29 is connected by means of cross pieces 30 and 31 to a corresponding oscillatable support arm 33. Thus rotation of shaft 3 through the action of cam 23 and the groove on the far side of that cam as viewed in FIG. 3, the cam follower 24, the arm 25, the connector 26, the pins 27 and 28 and the structure 29, 30, 31, 33 and shaft S results in oscillatory movement of the oscillatable support structure generally shown in FIG. 4 about shaft 1 through an angle of between 8 and 20 degrees.

For the purpose of rotating the suction cups 34–39 about the shaft S which is journally mounted in suitable bearings in the oscillatable arms 29 and 33, control means including a groove 40 is formed in the near side of cam 23 as viewed in FIG. 3. A cam follower 41 rides in groove 40 and is mounted on upright arm 42 which is supported for limited oscillation about the fixed shaft 15. Connector 43 is connected at one end by pin 44 to the upper end of arm 42 and at its opposite end by a pin 45 to crank arm 46 which is rigidly secured to one end of shaft 1. Thus rotation of shaft 3 imparts rotation to cam 23, oscillation to arm 42, reciprocation to connector 43 and oscillation to crank 46 which imparts oscillatory movement to shaft 1 which movement causes crank 47 to oscillate and reciprocate connector 48 which is pinned to crank 47 by bolt 49 and which is pinned to crank 50 by bolt 51 to impart oscillatory rotation to shaft S and which in turn swings the suction cups 34–39 which are secured to shaft S by clamps 34*a*, 36*a* and 38*a* through an angle of approximately 120 degrees. Suction is supplied to cups 34–39 by flexible tubes 34*b*, 35*b*, 36*b*, 37*b*, 38*b* and 39*b* respectively.

Figure 8:
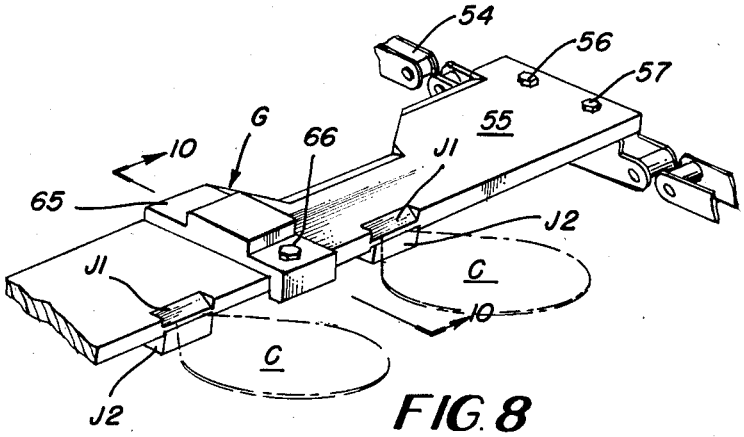
FIG. 8 is an enlarged fragmentary view of a portion of a conveyor to which container lids are fed and gripped by suitable means on the conveyor.

This swinging movement of the suction cups is best shown in FIG. 5. The solid line representation of the suction cup 39 shows the cup in proximity to the hopper H while the dotted line position of the suction cup 39 shows the suction cup in a position wherein a cover C is being inserted between the jaws J1 and J2 of the gripper device generally designated at G. The gripper device G is mounted on flight bars 55 which are secured by known means such as the bolts 56 and 57 to chains 54 as best shown in FIG. 8. During insertion of a cover C between the jaws J1 and J2, the chains 54 and the flight bars 55 and grippers G are stationary.

Figure 12:
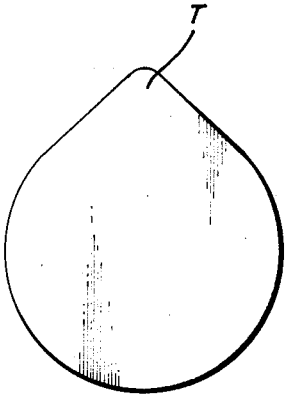
FIG. 12 is a plan view of a conveyor lid to which this invention is applicable.
Figure 13:
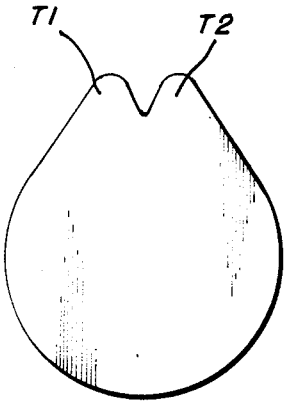
FIG. 13 is a modification of the lid shown in FIG. 12.

The container covers as shown in FIGS. 12 and 13 include a tab such as T shown in FIG. 12 or a pair of tabs such as T1 and T2 as shown with cover C1 in FIG. 13.

Figure 6:
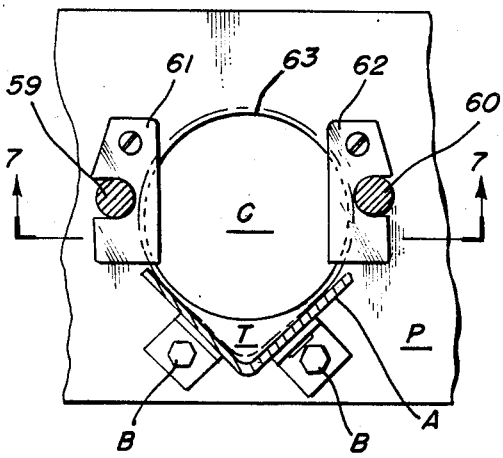
FIG. 6 is an enlarged cross sectional view taken along the line designated 6—6 in FIG. 5.
Figure 7:
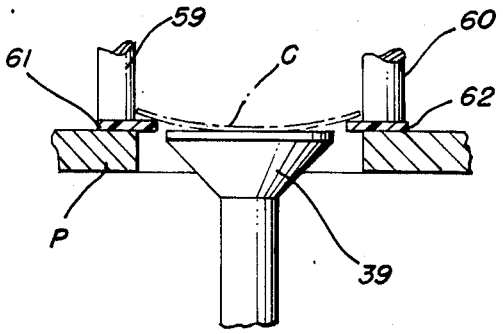
FIG. 7 is a cross sectional view taken along the line designated 7—7 in FIG. 6.

The hopper structure as best shown in FIGS. 6 and 7 is provided with a structure A which is angular in cross section and which is secured by bolts B and their associated brackets to a plate P having an aperture 63 therein and a pair of upright rods 59 and 60 are provided for engaging opposite sides of the cover C and for receiving the C-shaped openings formed in plates 61 and 62.

It is desirable to deform the covers such as C somewhat as shown by the bowed configuration of the cover C in FIG. 7. This bowing action tends to impart a measure of rigidity to the cover which is desirable in order to insure that when presented between the jaws J1 and J2, the tip such as T is properly positioned so as to enter between these jaws.

As is apparent from FIG. 8, the jaws J1 and J2 are arranged in pairs and each gripper element G is secured to flight bar 55 by means of an overlying bracket 65 which is secured to flight bar 55 by screw 66. Jaws J1 are mounted by pin 67 to a cylindrical post 68 secured as by a pressed fit or otherwise to the flight bar 55. Compression spring 69 is mounted with its upper end within a recess 70 formed in flight bar 55 and at its lower end in a recess 71 formed in a part of jaw J2. Engagement with jaw J2 is effected at the downwardly protruding portion 72 thereof as is best shown in FIG. 5.

Figure 10:
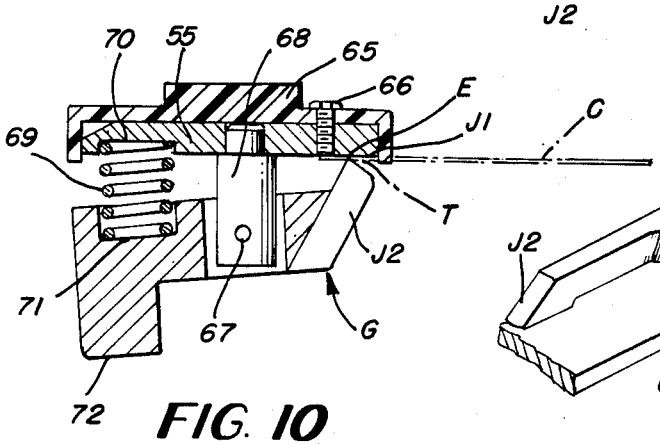
FIG. 10 is a cross sectional view taken along the line designated 10—10 in FIG. 8.
Figure 9:
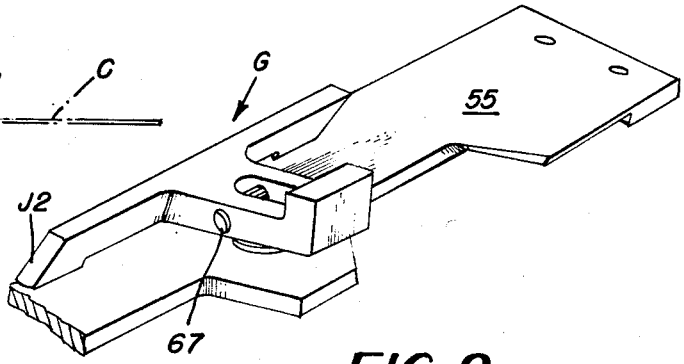
FIG. 9 is a view of a portion of the mechanism shown in FIG. 8 shown in perspective and as viewed from below.

Since this invention is particularly well suited for use in conjunction with an aseptic packaging machine, it is desirable to minimize contact of the jaws J1 and J2 with the cover such as C. Thus it is apparent that jaw J2 is configured so that its line of contact with the tab T of the cover C is of limited area and such contact is somewhat comparable to a knife edge as indicated at E in FIG. 10.

Figure 11:
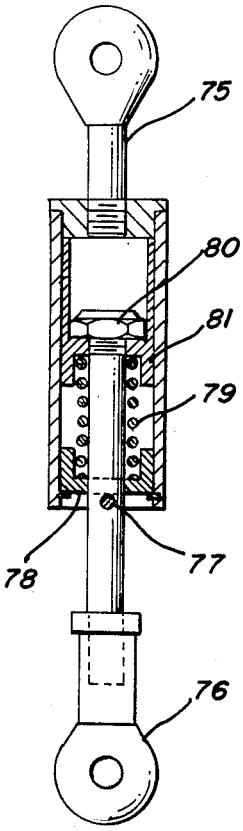
FIG. 11 is an enlarged view partially in section of a yieldable connector which is specially constructed so as to aid in absorbing mechanical tensile and compressional forces.

In order to minimize mechanical stress on the various parts, connectors such as 16, 26, 43 and 48 are constructed as shown in FIG. 11 so as to be yieldable in response to applied tensile or compressional forces. With respect to FIG. 11 eye bolts 75 and 76 are yieldable relative to each other. The pin 77 formed in eye bolt 76 engages a cup shaped element 78 and urges that element against compressional spring 79 so as yieldably to accommodate compressional forces imparted to the eye bolts 75 and 76. A tensile force applied to the eye bolts forces the nut 80 against the cup shaped element 81 and thus causes a compression of spring 79 so as yieldably to accommodate tensile forces applied to the eye bolts 75 and 76.

Figure 14:
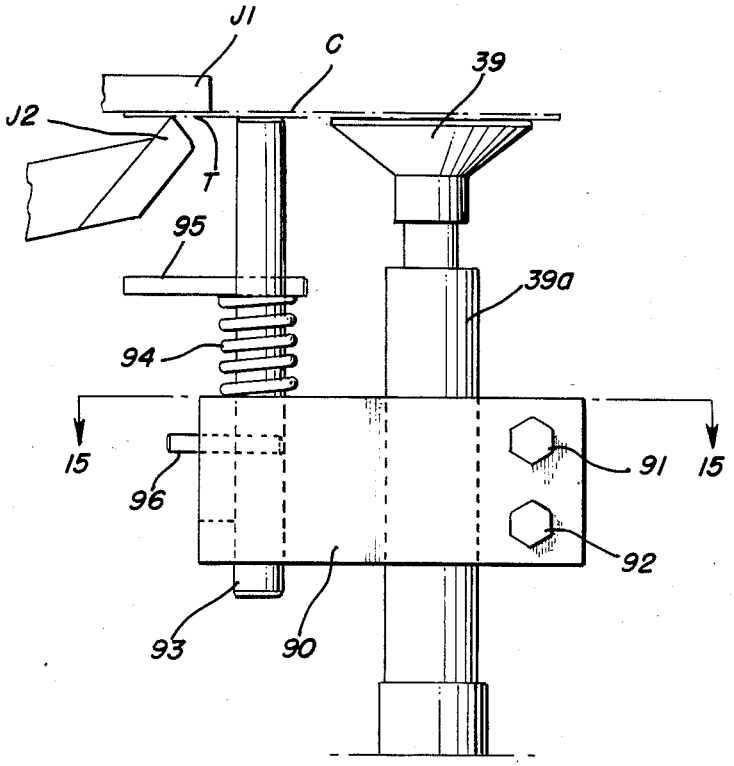
FIG. 14 is a side view of a special mechanism for positioning the portion of a container cover which is gripped by gripper means mounted on the conveyor.
Figure 15:
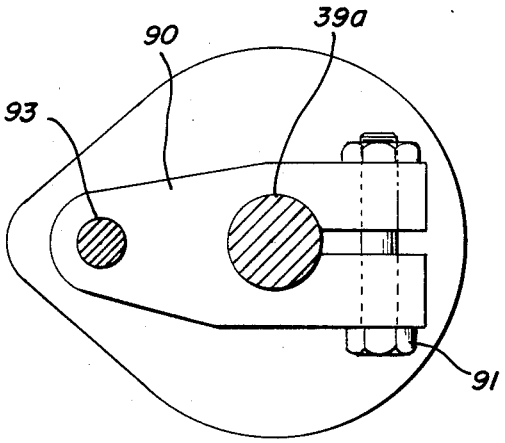
FIG. 15 is a cross sectional view taken along the line designated 15—15 in FIG. 14.
Figure 16:
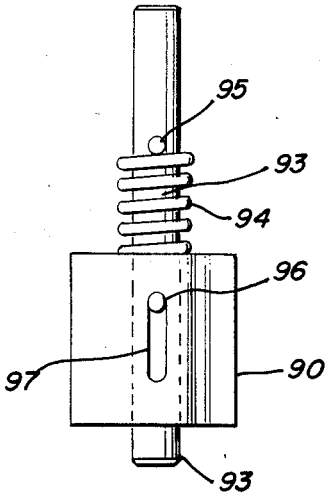
FIG. 16 is a view from the left side of FIG. 14.

Even though the containers C are bowed as shown in FIG. 7, it may occur that temperature changes, internal stresses within a container cover C may cause the tips such as T as in FIG. 12 or T1 and T2 as in FIG. 13 to move substantially out of the plane of the main body of the cover. In order to guard against such undesired movement of the tips of the covers in a direction away from the hopper H, the structure shown in FIGS. 14–16 may be employed. Thus as shown in FIG. 14 a bracket 90 may be secured about the shaft 39*a* of suction cup 39 by means of a pair of bolts 91 and 92. A plunger 93 is vertically reciprocal in an aperture formed in bracket 90. Due to the action of compression spring 94 which engages pin 95 mounted in plunger 93, upward motion is imparted to plunger 93 the upper limit of which is determined by pin 96 which is secured to plunger 93 and slidable within a slot 97 formed in bracket 90 as best shown in FIG. 16. Thus the position of the tip T of container C is determined between the jaws J1 and J2.

In order to limit the angle of oscillation of cranks such as 50 about the shaft such as S, a pair of stops 98 and 99 are mounted by bolts 100 and 101 on the oscillatable arm such as 29 as best shown in FIG. 5. These stops are provided with adjustable screws 102 and 103 so that the angle of oscillation of the crank such as 50 and the crank such as 47 is limited to approximately 120 degrees.

INDUSTRIAL APPLICABILITY

This invention is applicable to packaging machines generally and particularly to machines which function as aseptic packaging devices for flanged containers and affords an efficient arrangement for removing the covers for such containers from a hopper and for depositing the covers on a transporting mechanism such as a conveyor for subsequent manipulation and final application to a filled container.

We claim:

1. Mechanism for feeding a container cover out of a hopper and onto an intermittently movable conveyor for subsequent application to a filled container said mechanism comprisng a pivotally mounted oscillatable support arranged to move toward and away from the hopper, a suction cup rotatably mounted on said ocillatable support and engageable with a container cover for withdrawing the cover from the hopper, a flexibe tube for supplying suction pressure to said suction cup, control means interconnected with said suction cup for imparting movement to said suction cup relative to said oscillatable support so as to position said suction cup for deposit of the container lid onto said conveyor while said conveyor is stationary, a common driving mechanism connected to said oscillatable support and to said suction cup for imparting operating movement thereto, gripper means on the conveyor arranged to receive the container cover while the conveyor is stationary and to hold the container cover during movement of the conveyor, biasing means arrange to urge said gripper means toward its gripping position, and a gripper operating arm movable by said control means for engaging said gripper means so as to impart a cover receiving operation thereto followed by disengagement of said gripper operating arm from said gripper means and succeeding gripping of said cover.

2. Mechanism according to claim 1 wherein said oscillatable support is arranged to swing through an angle in a range between eight degrees and twenty degrees.

3. Mechanism according to claim 1 wherein said suction cup is arranged to rotate through an angle of approximately one hundred twenty degrees.

4. Mechanism according to claim 1 wherein a pair of spaced deformers are disposed in the hopper and engageable with opposite edges of the container cover to impart a bowing deformation to the cover.

5. Mechanism according to claim 1 wherein said control means imparts movement to said suction cup after movement of said oscillatable support toward the hopper is substantially completed.

6. Mechanism according to claim 1 wherein said gripper means comprises a gripping jaw whose area of contact with the container cover is generally comparable to a knife edge.

7. Mechanism according to claim 1 wherein the conveyor is stationary during transfer of the container cover to the conveyor.

8. Mechanism according to claim 1 wherein a cover engaging probe is mounted on said suction cup and engageable with a part of the cover so as to control the configuration thereof.

9. Mechanism according to claim 1 wherein said gripper means is operated by cam means movable by said common driving mechanism.

* * * * *